US012655599B2

(12) United States Patent
Olsen

(10) Patent No.: US 12,655,599 B2
(45) Date of Patent: Jun. 16, 2026

(54) MARINE FOUNDATIONS COMPRISING SUCTION PILES

(71) Applicant: Subsea 7 Norway AS, Stavanger (NO)

(72) Inventor: Christian Linde Olsen, Stavanger (NO)

(73) Assignee: SUBSEA 7 NORWAY AS, Stavanger (NO)

( * ) Notice: Subject to any disclaimer, the term of this patent is extended or adjusted under 35 U.S.C. 154(b) by 29 days.

(21) Appl. No.: 18/703,733

(22) PCT Filed: Oct. 25, 2022

(86) PCT No.: PCT/EP2022/079727

§ 371 (c)(1),
(2) Date: Apr. 23, 2024

(87) PCT Pub. No.: WO2023/072907

PCT Pub. Date: May 4, 2023

(65) Prior Publication Data

US 2025/0230621 A1 Jul. 17, 2025

(30) Foreign Application Priority Data

Oct. 25, 2021 (GB) ..... 2115318

(51) Int. Cl.
*E02D 27/52* (2006.01)
*E02D 15/08* (2006.01)
*E02B 17/00* (2006.01)

(52) U.S. Cl.
CPC ..... *E02D 15/08* (2013.01); *E02B 2017/0078* (2013.01); *E02B 2017/0091* (2013.01);
(Continued)

(58) Field of Classification Search
CPC ..... E02B 2017/0078; B63B 21/27
See application file for complete search history.

(56) References Cited

U.S. PATENT DOCUMENTS 1,931,249 A * 10/1933 Burkhardt ..... E21B 25/08 405/253
3,962,878 A 6/1976 Hansen
(Continued)

FOREIGN PATENT DOCUMENTS

CN 112253398 A 1/2021
FR 2368582 A1 5/1978
(Continued)

OTHER PUBLICATIONS

International Search Report of PCT/EP2022/079727 dated Feb. 7, 2023.

*Primary Examiner* — Sean D Andrish
(74) *Attorney, Agent, or Firm* — MATTINGLY & MALUR, PC

(57) ABSTRACT

A marine foundation such as a jacket or a tripod foundation for a wind turbine has suction piles that are subjected to cyclical loading of compression phases and tension phases in alternation. Each pile has a one-way valve that opens and closes autonomously in response to pressure differentials between the internal chamber and the surrounding water. The valve opens during the compression phases to effect fluid communication between an internal chamber of the pile and surrounding water. Water is thereby ejected from within the chamber through the valve. Conversely, during the tension phases, the valve closes and water is admitted into the pile only through soil within a skirt of the pile. Thus, a unidirectional, generally upward flow of water is driven through the soil within the skirt during the compression and tension phases, maximizing water flow friction and reducing the risk of liquefaction of the soil.

16 Claims, 5 Drawing Sheets

(52) U.S. Cl.
CPC ..... *E02D 2250/0053* (2013.01); *E02D 2250/0061* (2013.01)

(56) References Cited

U.S. PATENT DOCUMENTS

| | | | | |
|---|---|---|---|---|
| 4,575,282 | A * | 3/1986 | Pardue, Sr. | E02D 5/42 405/195.1 |
| 4,900,188 | A * | 2/1990 | Haselton | E02B 3/06 405/27 |
| 2009/0100724 | A1 | 4/2009 | McCoy, Jr. et al. | |
| 2013/0078109 | A1 * | 3/2013 | Schellstede | E02D 27/425 416/244 R |
| 2014/0314495 | A1 * | 10/2014 | Arentsen | E02D 7/10 173/206 |
| 2020/0277936 | A1 * | 9/2020 | Riemers | E02D 27/525 |

FOREIGN PATENT DOCUMENTS

| | | | |
|---|---|---|---|
| GB | 2375134 | A | 11/2002 |
| KR | 101240615 | B1 | 3/2013 |
| WO | 2010/143966 | A1 | 12/2010 |
| WO | 2010/143967 | A2 | 12/2010 |
| WO | 2015/043856 | A1 | 4/2015 |
| WO | 2019/070140 | A1 | 4/2019 |

* cited by examiner

MARINE FOUNDATIONS COMPRISING SUCTION PILES

BACKGROUND OF THE INVENTION

This invention relates to foundations that are designed to be embedded into the seabed, specifically suction piles. The invention aims to improve the resistance to movement of suction pile foundations once they are installed, allowing the size and hence the cost of such foundations to be reduced without sacrificing their efficacy.

Suction piles—also known in the art as suction anchors, suction cans, suction caissons or suction buckets—are commonly used in the renewable energy industry and in the oil and gas industry to anchor large offshore installations to the seabed. To do so, they are designed to engage soft seabed soil that typically comprises marine sediments such as sand or soft clay.

A suction pile is usually fabricated from steel and typically comprises an open-bottomed hollow straight tube defining a deep cylindrical skirt. The skirt may be several metres in length, for example ten metres. A major bottom portion of the skirt engages the seabed soil by friction or cohesion upon being embedded axially into the soil. The top of the skirt is closed by a top plate. A suction chamber is defined between the top plate, the skirt and the seabed soil trapped within the embedded skirt.

The top plate is penetrated by a suction vent or port through which water can be pumped out of the suction chamber. The resulting underpressure in the suction chamber promotes engagement of the suction pile with the soil. WO 2020/051330 describes various examples of ports or vents for suction piles. Another example of a vent is shown in GB 2521882, where a mobile plate is driven by a screw and a mechanism holds the plate at the required opening position.

Installation of a suction pile involves firstly allowing the pile to self-penetrate under its own weight into the seabed and secondly, after a short period of settlement, pumping water out of the resulting suction chamber to create a pressure differential.

Specifically, when a suction pile is landed on the seabed in an upright orientation, the skirt embeds partially into the seabed soil under the self-weight and momentum of the pile. Self-penetration of the pile ends when resistance to relative sliding movement between the skirt and the seabed soil balances the weight of the pile. The soil within the embedded skirt closes the bottom of the pile to create the suction chamber.

When seawater is subsequently pumped out of the suction chamber, underpressure in the chamber draws the top plate toward the seabed as the chamber contracts under external hydrostatic pressure. This forces the skirt to sink further into the soil, hence effecting fuller engagement of the suction pile with the soil. Thus, suction overcomes the resistance of friction or cohesion to force the skirt deeper into the seabed, hence enabling the pile to resist forces that will be applied after installation by equipment subsequently anchored to or supported on the pile.

By virtue of the piston effect of the closed top of the pile, any longitudinal movement of the installed pile requires water to flow into or out of the open bottom of the pile. Water flow friction, being resistance to that flow of water through the pores of the soil within the pile, is significantly greater-potentially more than five times greater-than skirt friction, being friction or cohesion between the skirt and the embedding seabed soil. A suction pile therefore engages with the seabed by virtue of water flow friction combined with skirt friction.

The top plate may comprise openable hatches or valves that are left open while lowering the suction pile through the water. This mitigates added mass by allowing water to flow freely through the pile as the pile moves downwards, hence reducing drag and improving stability. Once the skirt of the pile has been embedded into the seabed soil, the hatches or valves are closed so that a pressure differential can be created in the suction chamber. Any such hatches or valves are kept closed thereafter to enhance the water flow friction effect that resists longitudinal movement. For example, KR 101240615 discloses a suction pile foundation in which check valves are designed to open only during lowering and are closed in service.

Once embedded into the seabed soil, a suction pile can serve as an anchor or as a support for various types of subsea or surface equipment. For example, suction piles may be used for mooring or tethering a platform, a surface vessel or a buoy. Mooring lines and tethers act in tension and so apply upward and lateral traction forces to a pile. In that case, the pile must resist being pulled up out of engagement with the seabed or being pulled away from the vertical, or capsizing. Suction piles are also commonly used to support the weight of a structure such as a manifold. In that case, the pile must resist downward compression forces that tend to bury the pile deeper into the seabed.

In many cases, suction piles are subjected to only one type of loading in use, being either tension or compression. For example, where a suction pile supports the weight of a structure located deep underwater below the influence of surface dynamics, compressive loading dominates. However, where a suction pile supports a structure that is located close to or at the surface, cyclical loading becomes more significant. For example, cyclical loading may arise due to periodic application and relaxation of tension as a tethered floating structure moves under the influence of surface dynamics.

Cyclical loading becomes particularly significant where a suction pile supports the weight of a rigid structure or frame that extends above the surface, such as a wind turbine base or a jacket. This is because a structure exposed to the effects of weather tends to rock from side to side about an upright axis on encountering intermittent lateral forces from swells, waves and wind gusts, hence pivoting around horizontal axes as the structure tilts to-and-fro. This is a particular concern where a structure is supported by a group of laterally-spaced suction piles, for example positioned under respective legs of a tripod base structure or a jacket.

By virtue of lateral loads, a group of suction piles supporting an offshore structure such as a wind turbine may have at least one pile in tension and at least one other pile in compression at any given moment. This situation will reverse as swells or waves act on the structure from different lateral directions, with a period of typically six to twelve seconds between reversals. Thus, each pile will experience high-frequency cycles of compression and tension alternating in rapid succession as the structure supported by the group of piles tends to rock from side to side.

To illustrate this, FIGS. 1*a* and 1*b* show an offshore installation 10 exemplified by a wind turbine 12 supported by a jacket structure 14. The jacket 14 comprises legs 16 that surmount respective suction piles 18 embedded in the seabed 20. There may be three, four or more such legs 16 and at least a corresponding number of suction piles 18.

The jacket 14 extends from the seabed 20 to above the surface 22, where it and the wind turbine 12 are subject to a fluctuating lateral load L arising primarily from swells and waves impinging on the legs 16 of the jacket 14. By virtue of its vertical offset from the seabed 20, the load L generates a moment M that tends to tilt the installation 10 about a horizontal axis and therefore to sway the tower of the wind turbine 12 away from the vertical. Thus, a suction pile 18 on the side of the jacket 14 facing away from the load L is subjected to a downward compressive force $F_C$ whereas a suction pile 18 on the side of the jacket 14 facing toward the load L is subjected to an upward tension force $F_T$.

Where the suction piles 18 are embedded in sand, the compressive force $F_C$ and the tension force $F_T$ cause water to flow in the pores of the sand trapped within each suction pile 18. The suction pile 18 subjected to an upward tension force $F_T$ will try to move upwards and therefore water will be sucked in through the open bottom of the suction pile 18 as shown. Conversely, the suction pile 18 subjected to a downward compressive force $F_C$ will try to move downwards and therefore water will be pushed out through the open bottom of the suction pile 18 as shown.

As will be apparent from a comparison of FIGS. 1*a* and 1*b*, the load L reverses in direction periodically. Thus, the moment M also reverses, as do the vertical forces $F_C$ and $F_T$ acting on the suction piles 18 and hence also the direction of water flow through the open bottom of each suction pile 18. This cycle may repeat every six to twelve seconds as noted above. Rapid cyclical loadings are particularly problematic as bi-directional water flow, with little time for settling between flow reversals, can lead to liquefaction of the soil and hence potentially catastrophic failure of the foundation.

More generally, when a suction pile in subjected to compression, water builds up and flows within the volume of soil surrounded by the skirt. This build-up and flow of water reduces skirt friction and therefore reduces the performance of the pile when the pile is subsequently subjected to tension in a cyclical loading scenario. Generally, this is not a concern where a suction pile can be over-designed or over-sized to compensate for a slight loss of friction or cohesion with the surrounding soil. However, over-designing is costly and inefficient and may not always be possible to a necessary extent. For example, if the seabed comprises a shallow layer of soil overlying solid rock, it may not be possible to make the skirt long enough to ensure good performance in tension. In such cases, cyclical loadings that tend to loosen the seabed soil can weaken the foundation to an unacceptable extent, hence requiring a different and more expensive foundation solution.

FR 2368582 relates to a system for preventing the build-up of excessive pore water pressure in permeable foundations. The system operates in response to the pressure differentials created by sea swell, with a one-way valve opening when the sea pressure differs from a datum pressure by a specified value to allow fluid communication with a network of drainpipes, allowing the pore water to drain away into the sea.

US 2009/100724, on the other hand, discloses an underwater sediment evacuation system. The system comprises a suction pile and uses a series of pumps and valves to evacuate sediment from the internal volume of the suction pile.

WO 2015/043856 discloses a segmented suction pile with an attachment system to allow attachment of external equipment to the suction pile, particularly a subsea structure or an anchor line. The suction pile also includes a hole in the top surface of the pile for attaching a ventilation system for ejecting water, mud and air trapped in the pile.

U.S. Pat. No. 3,962,878 provides a foundation structure that uses the wave action of the sea to generate added stability against overturning forces. The foundation includes flap valves below the surface of the sea and just below the lowest wave trough level that open to allow water to escape through a central column of the foundation when the trough of a wave passes the flaps.

SUMMARY OF THE INVENTION

Against this background, the invention resides in a method of operating a marine foundation during cyclical loading that subjects a suction pile of the foundation to compression phases and tension phases in alternation. During the compression phases, a one-way valve is opened to effect fluid communication between an internal chamber of the pile and surrounding water, thereby ejecting water from within the chamber through the valve. Conversely, during the tension phases, the valve is closed and water is admitted into the pile through soil within a skirt of the pile. Thus, a predominantly upward flow of water can be driven through the soil within the skirt during the compression phases and the tension phases. Advantageously, the valve may open and close autonomously in response to pressure differentials between the internal chamber of the pile and the surrounding water.

Water may be ejected from the internal chamber through an external wall of the pile, such as a top plate of the pile that may partially define the chamber. In that case, the valve may be arranged to close an aperture that penetrates the external wall. Water may also, or instead, be ejected from the internal chamber through a plug within the pile, atop the soil within the skirt, that similarly may partially define the chamber. In that case, the valve may be arranged to close an aperture extending through the plug. In each case, water being ejected may flow through at least one porous barrier such as a foraminous filter, mesh, shroud or cage that is disposed upstream and/or downstream of the valve.

The method may comprise various preliminary steps. One such step involves opening the valve while lowering the pile through water toward the soil, thus allowing water to flow out of the valve after entering an open bottom of the skirt. Another such step involves opening the valve while preloading the pile after embedding the skirt in the soil, hence allowing water draining from the soil within the skirt to exit through the valve. In each of those steps, a movable valve element of the valve may be held in an open position and subsequently freed to move into a closed position, advantageously with the assistance of gravity.

Another preliminary step of pumping water from within the pile after embedding the skirt in the soil may be performed while keeping the valve closed. A further preliminary step may involve depositing ballast material over the pile and holding the deposited ballast material clear of the valve.

The inventive concept also embraces a marine installation comprising a structure supported by at least one suction pile having a skirt embedded in soil beneath a body of water. The or each pile has a one-way valve arranged to effect fluid communication between an internal chamber of the pile and water surrounding the pile to allow ejection of water from within the chamber through the valve. The valve is enabled to open autonomously when there is overpressure in the chamber due to the pile being under a compression load and to close autonomously when there is underpressure in the chamber due to the pile being under a tension load.

The structure may extend to a level close to or above the body of water, where the structure is subject to wave action. For example, the structure could be a wind turbine foundation.

At least two suction piles may be embedded in the soil with mutual horizontal spacing. For example, those suction piles could be under respective legs of a jacket or tripod foundation.

The valve may comprise a valve element that is free to move relative to a valve seat between a lower, closed position and an upper, open position. For example, the valve element could comprise a plate that is movable relative to the valve seat along at least one upright guide. In that case, the or each upright guide may have an upper enlargement that limits upward movement of the plate along the guide. Alternatively, the valve element could comprise a flap that is pivotable relative to the valve seat.

In summary, the invention ensures that water flows substantially unidirectionally in pores of the soil within a suction pile, and only flows when needed. This may be achieved by using a one-way valve or an equivalent mobile plate. If there is suction inside the pile under tension, then no water can exit from the top of the pile and the flow path for water flow is through the soil and upwardly into the open bottom of the pile. A few seconds later, when the pile is under compression, there will be an overpressure under the top plate of the pile. Water is then allowed to flow out of the top of the pile instead of being forced downwardly through the soil.

A benefit of the invention is that it creates a one-way flow inside a suction pile. Specifically, pore water in much of the soil within the pile will only flow one way, namely upwardly. This reduces the risk of liquefaction of the soil within the suction pile and so allows designers to rely upon a higher proportion of water flow friction. The result is an increase in the tension capacity of suction piles subject to fast cyclical loading, especially in sand.

The invention can also have benefit in a preloading phase, where seabed soil inside and around a suction pile will start to consolidate once a load is placed on the top of the pile. The invention beneficially adds to the normal consolidation path for excess pore water to escape from the soil within the pile.

The design of a wind turbine foundation supported by a group of suction piles is governed by the performance of the piles when in tension. Often, calculations are made on the assumption that resistance to movement relies solely or predominantly upon skirt friction. In contrast, optimising pore water flow in accordance with the invention allows water flow friction within a suction pile to be taken into greater account in the design of the pile. In this way, it may be possible to shorten the skirt substantially, for example to halve its length, without unduly limiting the performance of the pile. This reduces the cost of such piles, eases their transportation and installation and enables them to be installed in locations where larger conventional suction piles could not be accommodated.

Thus, the invention addresses the problem of improving water flow paths within suction piles and mitigates internal water consolidation under cyclical loading. This allows the invention to depart from the conventional practice of oversizing suction piles, instead allowing shorter piles to be used.

Embodiments of the invention implement a method for preventing loss of adherence of a suction pile subjected to vertical tension/compression cycles. The method comprises: installing at least one one-way valve in a suction pile, which pile may for example be positioned to support a leg of a jacket; embedding the suction pile in the seabed by self-penetration and by suction; and leaving the one-way valve free to open in service. For example, the one-way valve may be forced closed during a suction phase and reopened after the suction phase. In particular, the one-way valve may be forced open during a compression phase.

The one-way valve may, for example, extend through the top of the pile or may be located inside the pile beneath a removable top plate or lid.

An additional installation step of grouting and/or ballasting the pile with concrete and/or with rocks may take place after suction of the pile.

Embodiments of the invention also comprise a one-way fluid flow mechanism for a suction pile, the mechanism comprising: a transverse closure of an inner volume of the suction pile; a traversing bore through the transverse closure; and a one-way valve in fluid relation with the traversing bore.

The transverse closure could, for example, be a top plate of the pile. In that case, the one-way valve may comprise: an opening through the top plate; at least one vertical guide such as a rod, a bolt or a shaft; a mobile plate sliding on the vertical guide and arranged to close the opening completely when the plate is in a lower position; and an upper stopper that limits upward excursion of the plate.

The transverse closure could instead be a concrete plug atop the seabed soil within the pile. In that case, the one-way valve could comprise a tubular casing through the concrete plug. Such a tubular casing could have a filter at a lower end in fluid communication with a lower volume of the pile and/or a one-way flap or plate at an upper end.

Whilst sand and small debris may be pushed away by a flow of exiting water, the one-way valve may, for example, be enclosed inside a cage or a net preventing larger debris such as rocks entering and potentially jamming the mechanism during opening. For similar purposes, the valve may comprise a filter or the pile itself may contain a filtering mesh, located within the skirt of the pile.

A mechanism may be provided for forcing the one-way valve into an open or closed position, or for holding the one-way valve in either or both of those positions. For example, a removable pin such as a beta pin may pass through or otherwise engage the vertical guide to block movement of the mobile plate along the guide.

Thus, the invention is concerned with a marine foundation such as a jacket or a tripod foundation for a wind turbine. The foundation comprises suction piles that are subjected, in service, to cyclical loading of compression phases and tension phases in alternation. Each pile has a one-way valve that opens and closes autonomously in response to pressure differentials between the internal chamber and the surrounding water.

The valve opens during the compression phases to effect fluid communication between an internal chamber of the pile and surrounding water. Water is thereby ejected from within the chamber through the valve. Conversely, during the tension phases, the valve closes and water is admitted into the pile only through soil within a skirt of the pile. Thus, a unidirectional, generally upward flow of water is driven through the soil within the skirt during the compression and tension phases, maximising water flow friction and reducing the risk of liquefaction of the soil.

DETAILED DESCRIPTION OF THE INVENTION

Figure 1B:
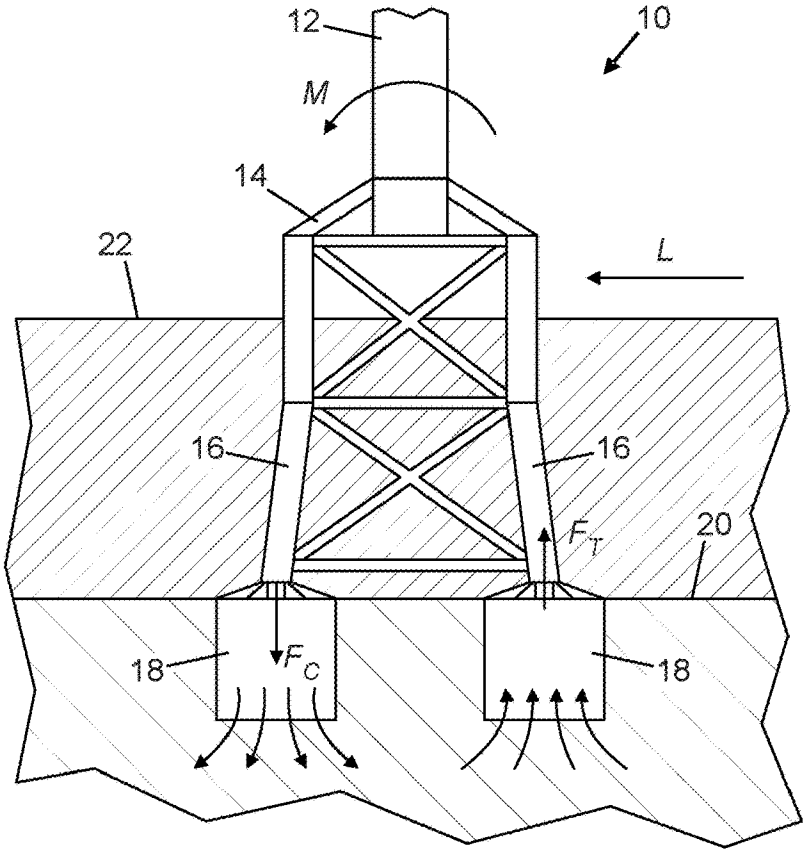
FIG. 1b Prior Art
FIGS. 1*a* and 1*b* are schematic side views of an offshore installation subjected to reversing lateral loads.
Figure 1A:
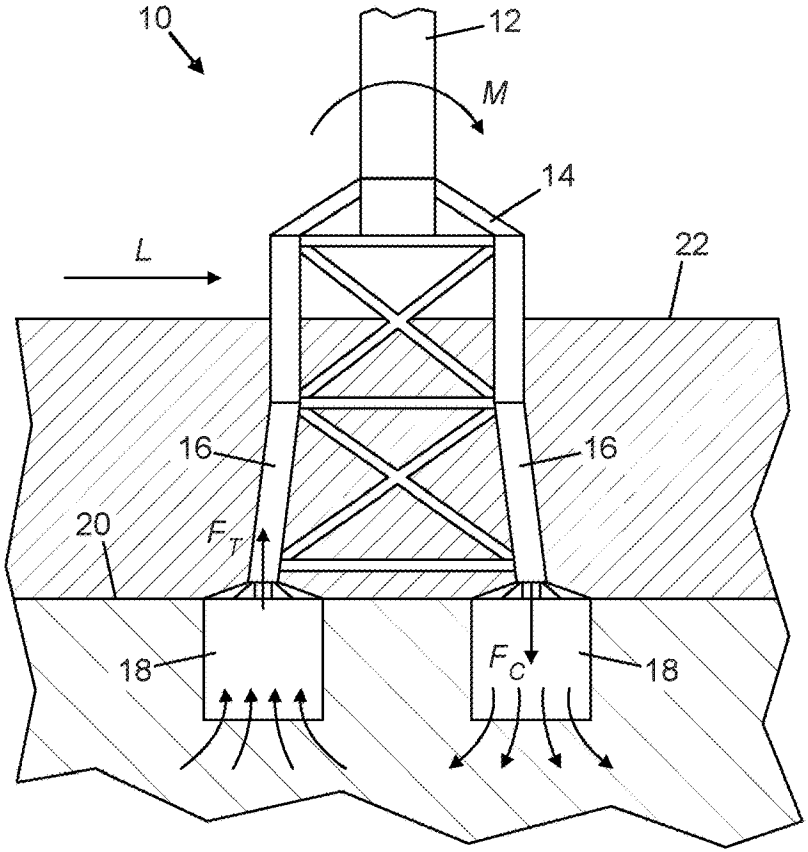
FIG. 1a Prior Art
Figure 2B:
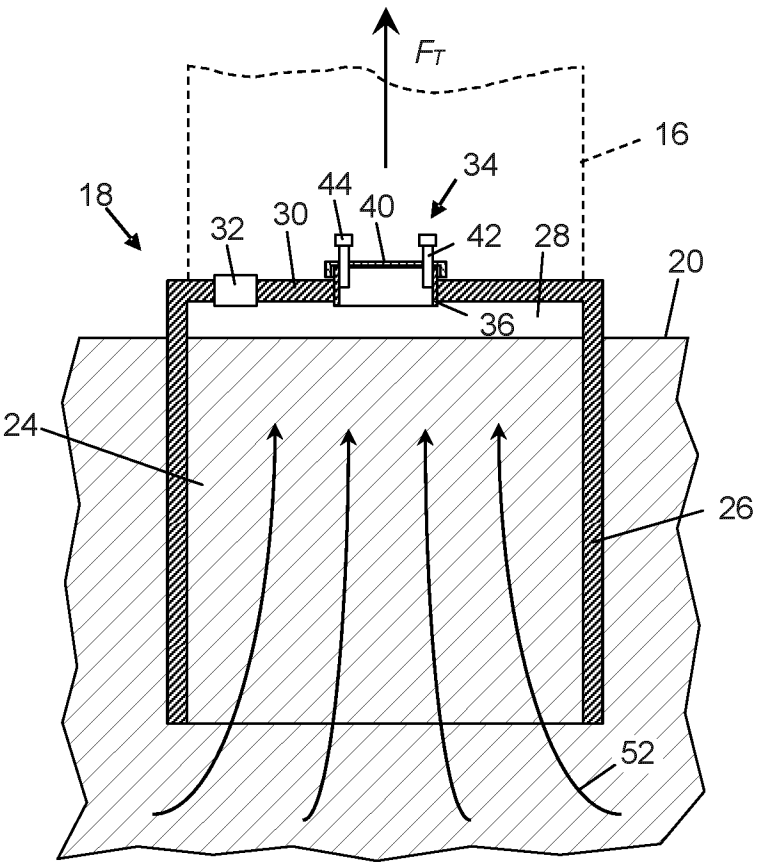
FIGS. 2*a* and 2*b* are schematic sectional side views of a suction pile of the invention during, respectively, compression and tension phases of cyclical loading.
Figure 2A:
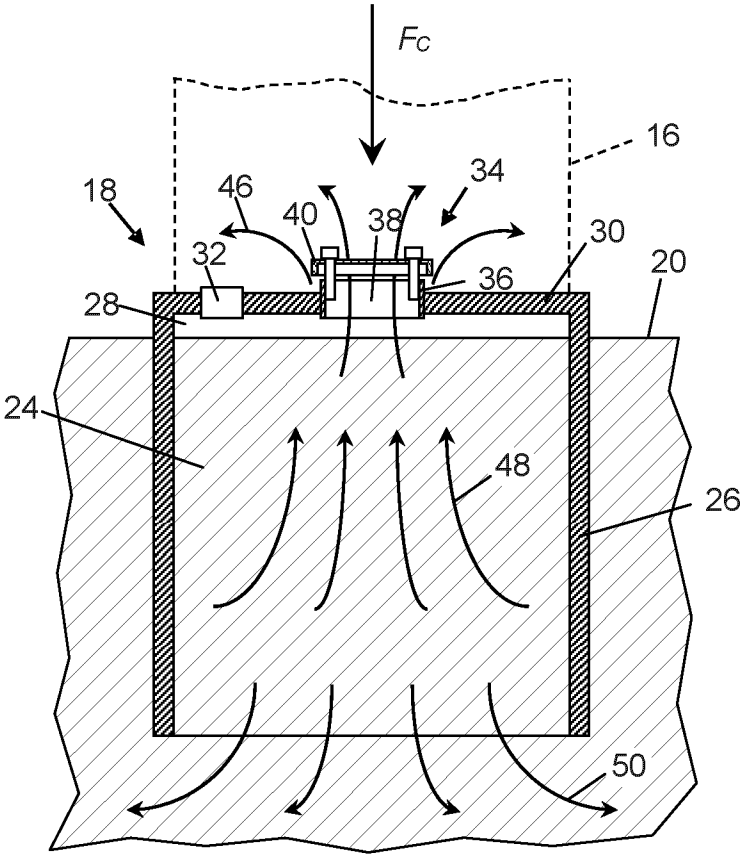

FIGS. 2*a* and 2*b* show a suction pile 18 of the invention in use, embedded in the soil 24 of the seabed 20, which is exemplified here by sand. The suction pile 18 is shown in FIGS. 2*a* and 2*b* during, respectively, compression and tension phases of cyclical loading. In successive cycles, alternating downward and upward loads $F_C$, $F_T$ are applied to the suction pile 18 by a supported structure such as a jacket leg 16 like that shown in FIGS. 1*a* and 1*b*.

Some seabed soil 24 is encircled by the tubular skirt 26 of the suction pile 18. As noted above, a suction chamber 28 is defined in the space within the skirt 26 between that soil 24 and the top plate 30. Water occupies the suction chamber 28 and fills pores between grains of sand in the soil 24, in fluid communication with the suction chamber 28.

In this example, the top plate 30 of the suction pile 18 comprises a conventional suction valve 32 through which water can be pumped out of the suction chamber 28 during a suction phase of installation. The suction valve 32 remains closed thereafter while the pile 18 remains in service.

In accordance with the invention, the suction pile 18 comprises a one-way valve 34 in a fluid communication path between the exterior of the pile 18 and an internal chamber of the pile 18 that communicates with the pores in the soil 24. In this case, that internal chamber is the suction chamber 28 located directly beneath the top plate 30. Conveniently, the valve 34 is mounted on or in the top plate 30, as in this example, although that location is not essential.

The valve 34 is enabled to open and close in response to reversal of pressure differentials between the exterior and the interior of the suction pile 18 when the pile 18 is in service and exposed to cyclical loads $F_C$, Fr. This is distinguished from a conventional suction valve 32, which is always closed except when pumping water out of the suction chamber 28 during installation. It is also distinguished from check valves or hatches of the prior art that are kept open only while lowering a suction pile to the seabed during installation and then are kept closed.

In this example, the valve 34 comprises a tubular housing or sleeve 36 mounted in a corresponding aperture 38 that penetrates the top plate 30. The sleeve 36 is open at its top and bottom ends to effect fluid communication, through the aperture 38, between the exterior of the suction pile 18 and the suction chamber 28 within the pile 18.

The valve 34 further comprises a valve element 40 in the form of a movable plate that defines a closure cooperable with the top end of the sleeve 36. The sleeve 36 therefore provides a seat for the valve element 40. The valve element 40 is guided in its movement by parallel upright guides 42 such as rods or bolts along which the valve element 40 can slide up and down. Upward excursion of the valve element 40 is limited by enlarged heads 44 at the upper ends of the guides 42 beyond which the valve element 40 cannot slide, thus defining a limited range of vertical movement of the valve element 40 relative to the top end of the sleeve 36.

In an upper, open position shown in FIG. 2*a*, the valve element 40 is disposed above and clear of the top end of the sleeve 36, thereby allowing fluid flowing through the aperture 38 to pass through the gap between the sleeve 36 and the valve element 40. Conversely, in a lower, closed position shown in FIG. 2*b*, the valve element 40 bears against and closes the top end of the sleeve 36, thereby blocking fluid flow through the aperture 38.

The valve element 40 is movable between the open and closed positions by pressure differentials between the exterior of the suction pile 18 and the suction chamber 28. Specifically, an overpressure in the suction chamber 28 relative to the exterior of the pile 18, characteristic of a compression phase shown in FIG. 2*a*, lifts the valve element 40 into the open position. Conversely, an underpressure in the suction chamber 28 relative to the exterior of the pile 18, characteristic of a tension phase shown in FIG. 2*b*, forces the valve element 40 into the closed position. The valve element 40 is also biased toward the lower, closed position by gravity.

It will be apparent from FIG. 2*a* that when the suction pile 18 is subject to downward load $F_C$ during a compression phase, overpressure in the suction chamber 28 lifts the valve element 40 into the upper, open position. The overpressure is thereby relieved by an upward flow of water 46 from the suction chamber 28 through the valve 34. Water 48 also flows upwardly toward the suction chamber 28 through the pores of the soil 24 within the skirt of the pile 18, in addition to some water 50 being expelled downwardly through the pores of the soil 24 via the open bottom of the skirt 26 in a conventional manner.

It will also be apparent from FIG. 2*b* that when the suction pile 18 is subject to upward load $F_T$ during a tension phase, underpressure in the suction chamber 28 pulls the valve element 40 down into the lower, closed position. The underpressure draws an upward flow of water 52 into the pile 18 via the open bottom of the skirt 26 and through the pores in the soil 24. As water cannot now enter the top of the pile 18 through the closed valve 34, the flow of water is essentially upward-only and unidirectional.

In the next compression phase, much of the water drawn into the suction pile 18 during the tension phase is expelled through the now-reopened valve 34 as shown in FIG. 2*a*. Thus, in this respect, the flow of water through the pores of the soil 24 within the skirt 26 is predominantly upward and substantially unidirectional throughout successive compression-tension-compression cycles. This maximises the beneficial effect of water flow friction and minimises the risk of liquefaction of the soil 24.

Figure 3:
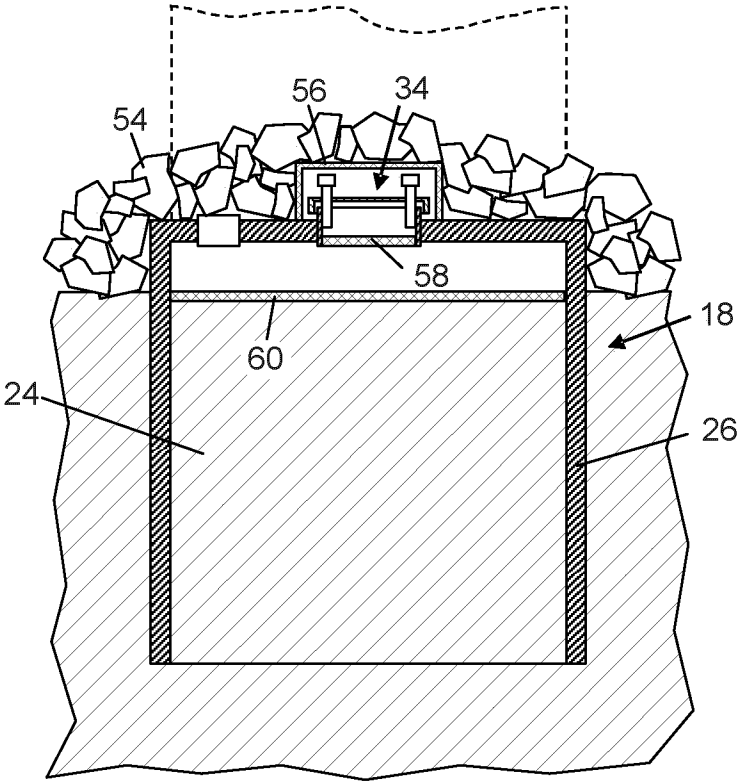
FIG. 3 is a schematic sectional side view of a variant suction pile of the invention.

Turning next to FIG. 3, this shows various porous barriers that allow water to flow through them while preventing soil or other debris such as rocks 54 from jamming, or otherwise disrupting, autonomous operation of the valve 34 in service of the suction pile 18. In this respect, FIG. 3 shows the option of a berm of rocks 54 deposited on top of the installed pile 18 as ballast. Grouting of the pile 18 after installation is also a conventional possibility.

One such barrier is a cage 56, or other foraminous shroud, that surrounds the external side of the valve 34 to keep rocks 54 away from the valve 34. Another barrier is a filter mesh 58 that spans the aperture 38 within the sleeve 36 of the valve 34. A further barrier is a filter mesh 60 that spans the interior of the skirt 26 between the valve 34 and the top of the soil 24 within the skirt 26. The filter meshes 58, 60 keep soil 24 within the pile 18 away from the underside of the valve 34. The cage 56 and the filter meshes 58, 60 can be used individually or in any combination of two or more such barriers.

Figure 4:
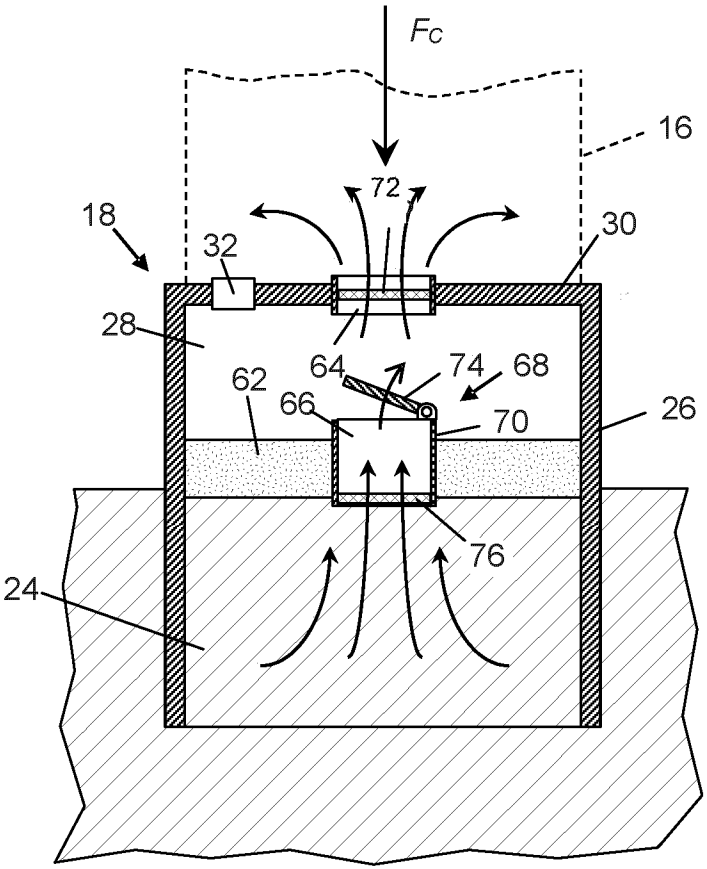
FIG. 4 is a schematic sectional side view of a further variant suction pile of the invention, shown during a compression phase.

Moving on to FIG. 4, this shows another embodiment of the suction pile 18 in which a concrete layer or plug 62 is cast or otherwise placed on top of the soil 24 within the skirt 26, under the top plate 30. In this case, fluid communication between the exterior of the pile 18 and the soil 24 within the skirt 26 is effected by an upper aperture 64 in the top plate 30 and a lower aperture 66 in the plug 62. At least one of those apertures 64, 66 can be closed by a one-way valve 68 in accordance with the invention.

In this example, the valve 68 comprises a tubular housing or sleeve 70 around the lower aperture 66 extending through the plug 62. The upper aperture 64 is always open but may be protected by a barrier mesh 72, as shown, that permits water flow but prevents rocks or other debris from falling into the pile 18 and potentially jamming the valve 68.

FIG. 4 shows an alternative arrangement for the valve 68, which could also be applied to the preceding embodiment. Conversely, the valve 34 of the preceding embodiment could be applied to this embodiment. In this case, the valve element is a flap 74 that is hinged to the top of the sleeve 70. The sleeve 70 is spanned by a filter mesh 76 to keep the soil 24 away from the flap 74.

In an upper, open position shown in FIG. 4, the flap 74 is hinged away from the top of the sleeve 70, thereby allowing fluid flowing upwardly through the lower aperture 66 to pass through the gap between the sleeve 70 and the flap 74. Conversely, in a lower, closed position, the flap 74 bears against and closes the top of the seeve 70, thereby blocking fluid flow downwardly through the lower aperture 66. Thus, as in the preceding embodiment, upward, unidirectional flow of water through pores of the soil 24 within the skirt 26 is encouraged during both the compression phase shown in FIG. 4 and a subsequent tension phase when load on the pile 18 reverses.

It would be possible to reverse the arrangement of FIG. 4 by positioning the valve 68 in the upper aperture 64 and leaving the lower aperture 66 open, save for the option of a filter mesh 76.

Figure 6:
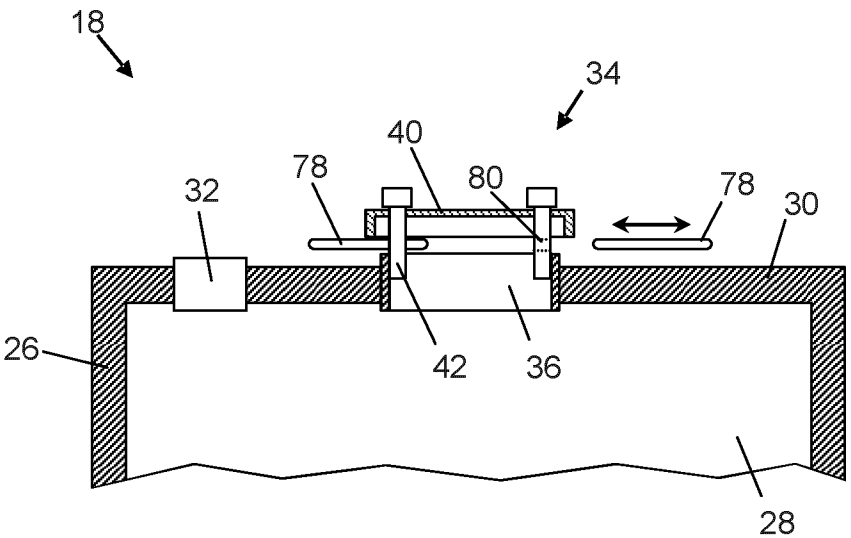
FIG. 6 is an enlarged detail view showing provisions for holding a one-way valve open while lowering a suction pile of the invention through water or during a preloading phase of installation.
Figure 5:
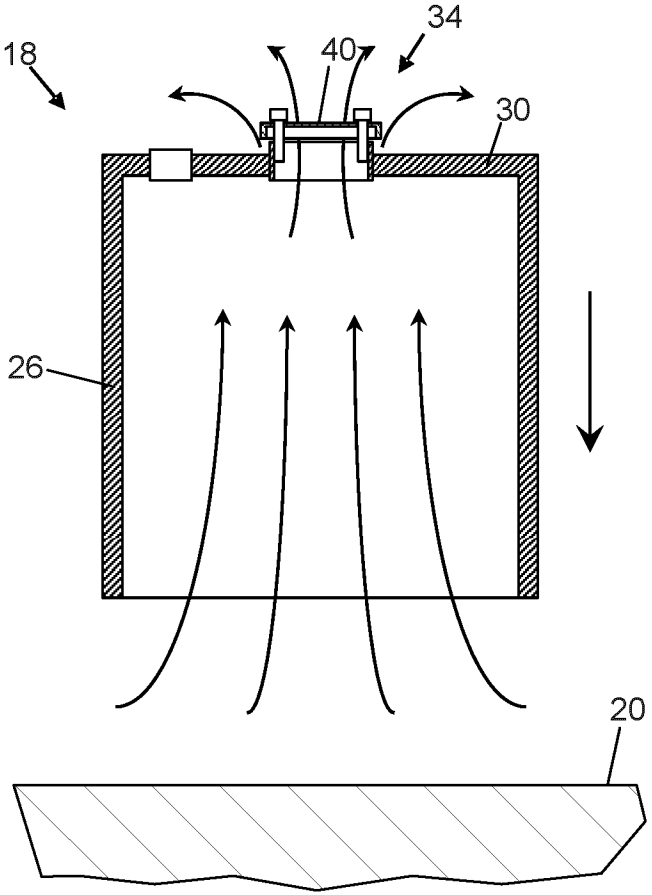
FIG. 5 is a schematic sectional side view of a suction pile of the invention while being lowered through water toward the seabed during installation.

FIGS. 5 and 6 show that the invention may also have benefit when lowering a suction pile 18 toward the seabed 20. Here, a one-way valve 34 in the top plate 30 of the pile 18 is open when lowering, as shown in FIG. 5, so that water can flow along and through the pile 18 to the benefit of stability.

The valve element 40 may assume the upper, open position shown in FIG. 5 in response to differential pressure or drag forces as the pile 18 falls through the water column. Alternatively, or additionally, the valve element 40 may be held open temporarily during the lowering operation. For example, FIG. 6 shows removable pins 78 such as beta pins that are received in transverse bores 80 extending through the guides 42. When engaged with the guides 42, the pins 78 bear against the underside of the valve element 40 to prevent the valve element 40 dropping into the closed position against the top of the sleeve 36. When the pile 18 reaches the seabed 20, the pins 78 can be removed, for example by an ROV, to allow the valve 34 to close. The valve 34 is then enabled to open and close automatically and autonomously in response to cyclical compression and tension loads $F_C$, $F_T$ applied to the pile 18 as shown in FIGS. 2*a* and 2*b*.

In principle, the pins 78 could be replaced or repositioned above the valve element 40 after the valve 34 closes so as to hold the valve element 40 in the closed position against the top of the sleeve 36. This may be beneficial to ensure the integrity of the suction chamber 28 during a suction phase of installation in which water is pumped out through the suction valve 32. However, an underpressure applied to the suction chamber 28 via the suction valve 32 will tend to hold the valve 34 closed in any event.

Figure 8:
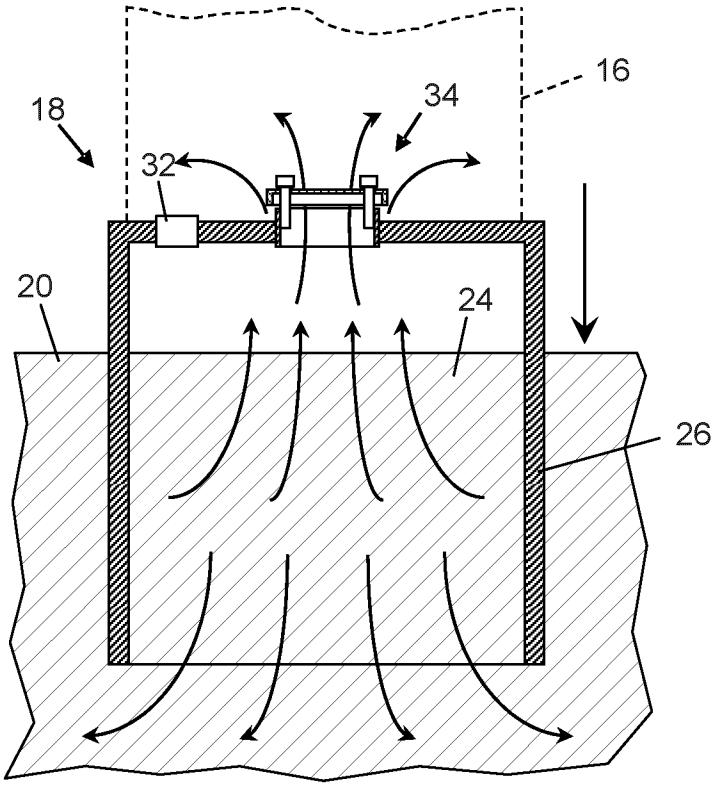
FIG. 8 corresponds to FIG. 7 but shows a suction pile of the invention during the same phase of installation.
Figure 7:
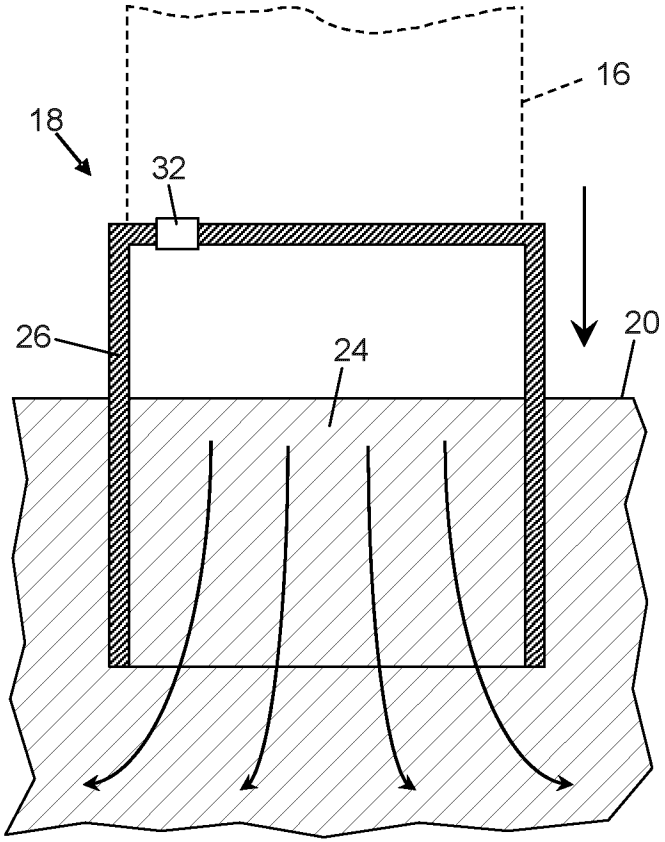
FIG. 7 Prior Art
FIG. 7 is a schematic sectional side view of a conventional pile as the surrounding seabed soil consolidates during a preloading phase.

Turning finally to FIGS. 7 and 8, these drawings show the behaviour of a suction pile 18 during a pre-loading phase of installation. In that phase, as the pile 18 settles into the seabed 20 under downward load, the soil 24 of the seabed 20 consolidates around the skirt 26 of the pile 18 as water drains through the pores of the soil 24. The behaviour of a conventional pile 18 shown in FIG. 7 may be compared with that of a pile 18 of the invention as shown in FIG. 8. In FIG. 7, water can only drain downwardly from the soil 24 within the skirt 26 and out through the open bottom of the skirt 26. This limited flow of water out of the pile 18 slows the process of consolidation. In contrast, in FIG. 8, water can escape from the soil 24 within the skirt 26 both upwardly through the one-way valve 34 and downwardly through the open bottom of the skirt 26. Beneficially, this enhanced flow of water out of the pile 18 by virtue of plural drainage paths accelerates the process of consolidation.

The one-way valve 34 could be held open during the pre-loading phase shown in FIGS. 7 and 8, for example using an arrangement of pins 78 like that shown in FIG. 6. Alternatively, an overpressure in the suction chamber 28 can open the one-way valve 34 to an extent sufficient to promote drainage of water through the top plate of the pile 18.

Many other variations are possible within the inventive concept. For example, a one-way valve of the invention could be integrated with, or also serve as, a suction valve so that one valve performs both functions.

Upward excursion of the valve element could be limited in other ways, for example by a cage or other protective barrier structure surrounding the one-way valve.

The valve element of the one-way valve could be biased into the closed position, for example by a spring acting downwardly from above the valve element.

The invention claimed is:

1. A method of operating a marine foundation during cyclical loading that subjects a suction pile of the foundation to compression phases and tension phases in alternation, the method comprising:

during the compression phases, opening a one-way valve to effect fluid communication between an internal chamber of the pile and surrounding water, thereby ejecting water from within the chamber through the valve; and during the tension phases, closing the valve and admitting water into the pile through soil within a skirt of the pile.

2. The method of claim 1, comprising opening and closing the valve autonomously in response to pressure differentials between the internal chamber of the pile and the surrounding water.

3. The method of claim 1, comprising driving an upward flow of water through the soil within the skirt during the compression phases and the tension phases.

4. The method of claim 1, comprising ejecting water from the internal chamber through an external wall of the pile.

5. The method of claim 4, wherein the valve is arranged to close an aperture in the external wall.

6. The method of claim 4, wherein the external wall is a top plate of the pile.

7. The method of claim 1, comprising ejecting water from the internal chamber through a plug within the pile, atop the soil within the skirt.

8. The method of claim 7, wherein the valve is arranged to close an aperture in the plug.

9. The method of claim 1, comprising passing the water being ejected through at least one porous barrier disposed upstream and/or downstream of the valve.

10. The method of claim 1, comprising a preliminary step of opening the valve while lowering the pile through the surrounding water toward the soil, so that the surrounding water can flow along and through the pile.

11. The method of claim 10, comprising holding a movable valve element of the valve in an open position during the preliminary step, and subsequently freeing the valve element to move into a closed position.

12. The method of claim 1, comprising a preliminary step of opening the valve while pre-loading the pile after embedding the skirt in the soil, allowing water draining from the soil within the skirt to exit through the valve.

13. The method of claim 1, comprising, preliminarily, pumping water from within the pile through a suction valve after embedding the skirt in the soil.

14. The method of claim 13, comprising keeping the one-way valve closed during the pumping step.

15. The method of claim 1, comprising, preliminarily, depositing ballast material over the pile and then holding the deposited ballast material clear of the valve.

16. The method of claim 1, comprising closing the valve with assistance of gravity.

* * * * *